United States Patent [19]

Robinson

[11] 4,373,849

[45] Feb. 15, 1983

[54] REFUSE CONTAINER LIFT POCKET

[75] Inventor: Jimmie R. Robinson, Silver Lake, Ind.

[73] Assignee: Flint & Walling, Inc., Silver Lake, Ind.

[21] Appl. No.: 171,751

[22] Filed: Jul. 24, 1980

[51] Int. Cl.[3] ..... B65F 3/04

[52] U.S. Cl. ..... 414/408; 294/73

[58] Field of Search ..... 414/406–408, 414/607, 608; 294/68, 69 R, 73

[56] References Cited

U.S. PATENT DOCUMENTS 3,195,942 7/1965 Dempster et al. ..... 414/408 X 3,946,885 3/1976 Menkel, Jr. et al. ..... 414/408

OTHER PUBLICATIONS

Par-Kan Front Loading Containers by Parker Industries, Inc.

*Primary Examiner*—Leslie J. Paperner

*Attorney, Agent, or Firm*—Marmaduke A. Hobbs

[57] ABSTRACT

A refuse container lift pocket for use on containers lifted and inverted over collecting truck bins, in which the pocket operates with lift arms from the truck to automatically tilt the container toward the truck as the container is lifted. The pocket has a bottom plate parallel with the container floor and a top plate in spaced relation to the bottom plate and angling downwardly away from the pocket entrance. A side wall is disposed between the top and bottom plates.

6 Claims, 4 Drawing Figures

REFUSE CONTAINER LIFT POCKET

In locations where large amounts of refuse will be created, such as at public buildings, apartment complexes, or the like, refuse containers having capacities of several cubic yards or more frequently are provided, so that the refuse may be accumulated in a neat and sanitary manner for collection. Normally, the refuse collecting truck is equipped with a mechanism for lifting the container and inverting it over a collecting bin on the truck. After the container is emptied, it is placed back on the ground for further deposit of refuse. This type of collecting system enables one worker driving a collecting truck to collect much more refuse than several men could collect by loading the refuse into the truck by hand. Additional advantages of the container type collecting method include the elimination of unsightly piles of refuse placed for collection, the consolidation of the refuse into a small area, and the protection of the refuse from dogs, cats or other stray animals which may scatter the refuse if placed out of doors unprotected.

One type of lifting mechanism commonly used on trucks for collecting refuse accumulated in large bins includes two lift arms which extend outwardly from the front of the truck, and are inserted into housing structures or pockets on opposite sides of the refuse container as the truck approaches the container. When the arms are inserted sufficiently far into the pockets, the truck is stopped, and the arms are hydraulically elevated to raise and invert the refuse container over a bin on the back of the truck. As the container is inverted, hinged doors on the top thereof fall open, permitting the refuse to fall out of the container and into the bin on the truck. After the container is emptied it is lowered to the ground, and the truck is backed away from the container to remove the lift arms from the pockets.

The present invention relates to an improvement in the housing structures or lift pockets on the sides of the container which receive the lift arms from the collecting truck. In the previous type of pocket used for refuse containers, the top of the pocket, which rests on the lift arms as the container is raised, is parallel with respect to the top and bottom of the container. As the arms are inserted into the pockets, one or the other arm may contact the top or bottom of the pocket and slightly jar the container, moving it from where it rests on the ground. This problem is especially pronounced when the area surrounding the container is uneven so that the truck and container do not align evenly with each other. Further, it has been found that a lifting and inverting mechanism will function more efficiently if the container is slightly tilted toward the truck during the lifting to obtain effective clearance. The desired tilt has been obtained in the past by providing additional pivot points and hydraulic cylinders to angle the lift arms, thereby tilting the container, after the arms have been inserted into the pockets; however, this approach alone complicates the operation.

It is therefore one of the principal objects of the present invention to provide refuse container lift pockets which assist in positioning the container at the optimum angle with respect to the collecting truck for lifting and inverting the container, and which make insertion of the lift arms into the pockets and removal of the lift arms from the pockets easier, and minimize the possibility that misalignment of the truck and container will cause the container to be improperly mounted on the lift arms.

Another object of the present invention is to provide improved lift pockets for refuse containers which may be installed on old as well as new containers, and which can be added to new or old containers without substantial modification of the basic container structure.

A further object of the present invention is to provide an improved lift pocket for refuse containers which decreases the potential for accidental movement of the container as the lift arms are being removed from or inserted into the lift pocket, and which provides a large surface for resting on the lift arms of the collecting truck, thereby providing a stable mounting of the container on the lift arms.

Yet another object of the present invention is to provide a refuse container having improved lift pockets which can be manufactured economically and attached to the container quickly, easily, and inexpensively, and which do not require significant maintenance, up-keep, or other future attention.

Additional objects and advantages of the present invention will become apparent from the following detailed description and the accompanying drawing wherein.

Figure 1:
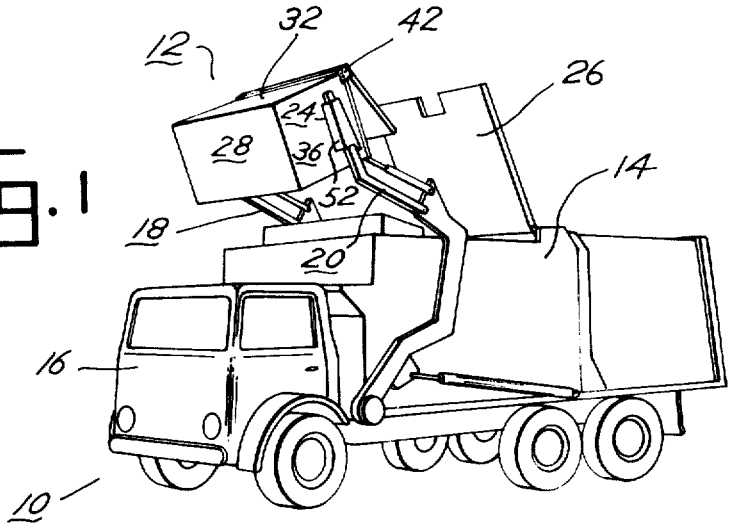
FIG. 1 is a perspective view of a refuse collecting truck and a refuse container having lift pockets embodying the present invention.
Figure 2:
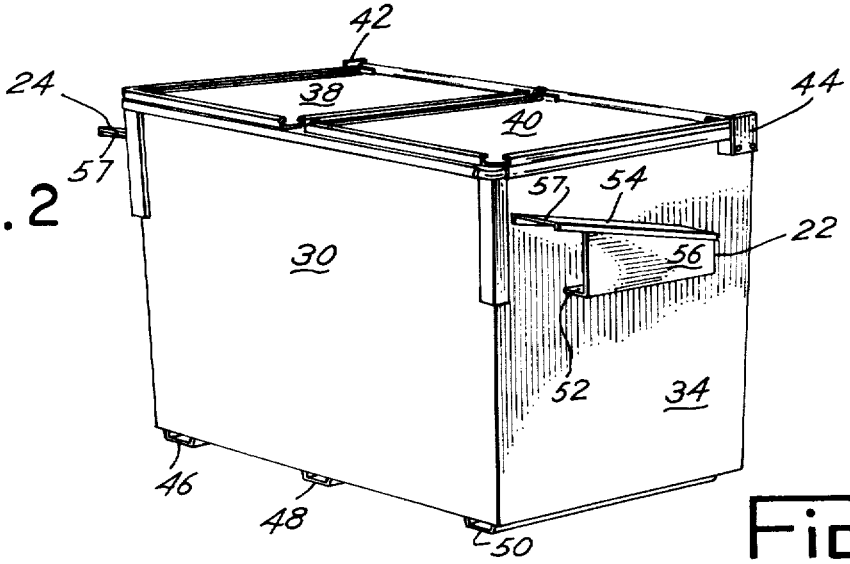
FIG. 2 is an enlarged perspective view of the refuse container shown in FIG. 1.

Referring more specifically to the drawings, and to FIG. 1 in particular, numeral 10 designates a refuse collecting truck which has lifted a refuse container 12 to a position for emptying the container into a bin 14 on the rear of the truck behind an operator's cab 16. Lift arms 18 and 20 from the hydraulic lift mechanism of the truck are inserted into lift pockets 22 and 24 on the container, and the arms are raised to lift the container and invert it over bin 14. A door 26 at the top of the bin opens as the container is lifted, permitting the refuse to fall from the container into the bin.

Container 12 may be of a variety of shapes, and the lift pockets of the present invention work equally well on small and large capacity containers. The container is essentially a rectangular box having a floor 28, a front wall 30 and a rear wall 32. End walls 34 and 36 are disposed between the front and rear walls, and lift pockets 22 and 24 are attached to the end walls. Lids 38 and 40 are disposed on the top of the container, and are attached thereto by hinges 42 and 44, so that, as the container is inverted over the truck, the lids swing open, permitting the refuse to fall from the container into the collecting bin. Skids 46, 48 and 50 are disposed on the underside of floor 28 to raise the floor off the surface upon which the container rests and to permit circulation of air beneath the container, thus retarding the deterioration of the floor by keeping the floor dry.

Lift pockets 22 and 24 are disposed on opposite sides of the container, and are attached to end walls 34 and 36, respectively. The container is of appropriate width so that as truck 10 approaches, lift arms 18 and 20 thereof, if properly aligned vertically, will enter the lift pockets. The present lift pockets are mirror images of each other, hence like numerals will represent similar parts. Each lift pocket has a bottom plate 52 which is attached to the end wall and extends outwardly therefrom. Normally the plate is attached to the end wall by spot welding or bead welding along the joint between the bottom plate and the end wall. The bottom plate 52 is substantially parallel with floor 28, thus being level with respect to the surface on which the container is placed. A top plate 54 is disposed above the bottom plate in spaced relation thereto, and is attached to the end wall in a manner similar to the attachment of the bottom plate, such as by spot or bead welding. The top plate extends laterally outwardly from the end wall substantially the same distance as does bottom plate 52; however, unlike the bottom plate, top plate 54 is disposed at an angle with respect to floor 28 of the container. The top plate angles downwardly toward the back of the container so that the distance between top plate 54 and bottom plate 52 is greater at the front or entrance end of the pocket than at the back end. A tapered side plate 56 is disposed between the top plate and bottom plate so that when the pocket is attached to the end wall, a slot is formed for receiving the lift arm from the truck, the slot being defined by bottom plate 52, top plate 54, the end wall of the container and side plate 56. Top plate 54 may be longer than side plate 56 and bottom plate 52, and an extension 57 thereof projects past the side plate and bottom plate in the direction of front wall 30. The extensions of the top plates, being disposed near front wall 30, make the pockets more easily seen by the truck driver as he approaches the container so that alignment of the lift arms with the pockets is easier. Further, the extensions provide additional support for the container on the lift arms.

Although the present pocket has been described as having a bottom plate, top plate, and a side plate, it should be understood that the previously mentioned components may be integrally formed from one piece of material, normally metal, or may be of two piece construction. Hence, the side plate and bottom plate may be one integral L-shaped piece having a tapered edge defining the upper edge of the side plate, and the top plate may be a separate piece joinable by welding or other attachment means to the integral bottom and side plate structure.

Figure 3:
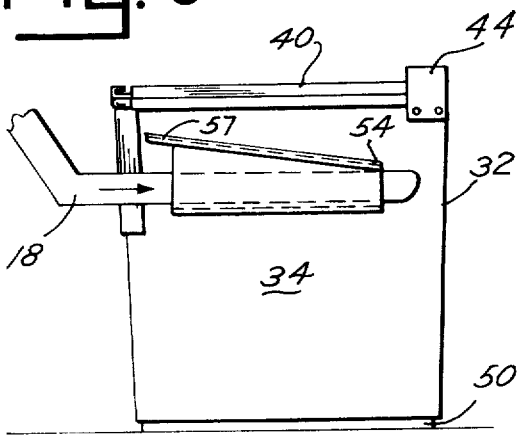
FIG. 3 is a side elevational view of the refuse container and lift pocket, showing the position of the pocket and truck lift arm when the container is on the ground.
Figure 4:
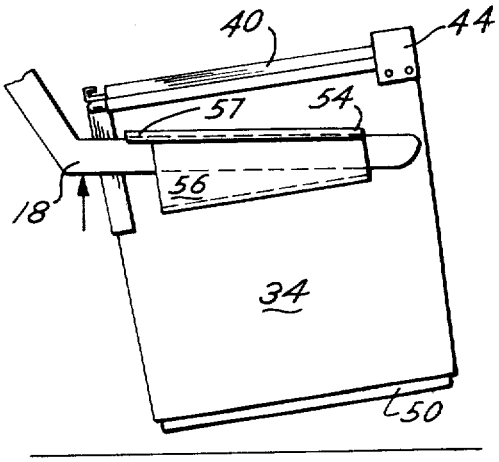
FIG. 4 is a side elevational view of the refuse container and lift pocket shown in the preceding figure but showing the relative positioning of the pocket and arm after the container has been lifted from the ground.

In the use and operation of a container having lift pockets embodying the present invention, the container is placed in a convenient location for the deposit of refuse. When the container is full, or when regularly scheduled periodic dumping is to take place, a refuse collecting truck approaches the container from the front side of the container at front wall 30. Lift arms 18 and 20 are vertically adjusted to align with the openings to pockets 22 and 24. Extensions 57 are visible to the driver as the truck approaches the container, and may be used as guides to align the lift arms. The tapered construction of the pockets provides a relatively large front opening to the pocket, thereby permitting entrance of the lift arms even if the container is leaning to one side or the other with respect to the truck. In a level alignment, the arms enter the pockets and do not touch, or make only minimal contact with either the container or the pocket until the ends of the arms have been inserted through the back end of the pocket. While the container remains upon the ground, only a small area at the back of the pocket will contact the lift arm. This relationship is shown in FIG. 3, wherein only the very rearward edge of top plate 54 is in contact with the upper surface of lift arm 18. As the lift arms are raised by the hydraulic system of the truck, container 12 will begin to tilt toward the truck. When the container has been lifted completely off the ground, the entire length of top plate 54 rests upon the top of lift arms 18 and 20. This relationship is shown in FIG. 4. Thus, the container is automatically moved to the position wherein it is tilted toward the truck, which is the desirable position for the container as the lift and inversion of the container take place. Previously the lifting mechanism was used to tilt the container toward the truck; however, with the present container structure, the container will automatically achieve the tilted position during the initial lifting operation. From the position shown in FIG. 4, the container is raised above the cab and tilted toward bin 14 on the truck. Lids 38 and 40 swing open and the refuse falls from the container into the bin. After the container has been completely emptied, it is lowered and returned to its position on the ground. As the skids on the underside of floor 28 come in contact with the ground, normally the area beneath front wall 30 will contact first, and the rear portion will settle down onto the ground as the lift arms are lowered further. When the container is fully resting on the ground, substantially the entire length of the top plate will be in spaced relation to the lift arm, with only the rear edge thereof in contact with the arm. Hence, after only a slight rearward movement of the truck, the lift arms will no longer contact the pocket or the container. As the truck is backed away from the container, there is substantially less likelihood that one or the other lift arm will contact the container or pocket and accidentally move and misalign the container from the desired position, than in the previous designs wherein the lift pocket was substantially rectangular in transverse cross section.

The present pockets not only assist the truck operator for aligning the lift arms with the pockets as the truck is driven forwardly toward the refuse container, but also automatically tilt the container to optimum position for lifting. Further, the pockets of the present invention can replace previous rectangular pockets without substantial modification of the container. The original pocket can be cut from the container by use of a torch or the like, and the present pocket attached in its place to convert the container to the automatically tipping type. Use of the pocket to tip the container is particularly advantageous over the use of hydraulically adjustable lift arms to perform the initial tilt of the container since the pocket performs the tilt automatically, thereby simplifying the operation.

Although one embodiment of a refuse container lift pocket has been described in detail herein, various changes may be made without departing from the scope of the present invention.

I claim:

1. In combination with a vehicle having lift arms having horizontal upper surfaces and being forwardly movable on a horizontal plane, and a refuse container of the type which is lifted and inverted by a refuse collecting truck for emptying the refuse contained therein and which has a front wall, a back wall, end walls therebetween, a floor, and a hinged lid: a lift pocket mounted on and projecting outwardly from the outside surface of each end wall, each pocket having opposite open ends and a top plate, a bottom plate and a side plate joined to the outer edges of the top and bottom plates, said top plate sloping downwardly toward the rear end of the pocket relative to the horizontal upper surface of said arm, for initial engagement at said rear end by said horizontal upper surface of said arm for supporting and tilting the container toward the truck as the container is lifted for inversion to remove the refuse therefrom.

2. In combination with a refuse container, a lift pocket as defined in claim 1, in which said top plate projects forwardly to a point near the front edge of the container for easy visibility from the truck.

3. In combination with a refuse container, a lift pocket as defined in claim 2 in which said top plate is even with said bottom and side plates at the back of said pocket and has an extension which projects past said bottom and side plates in the direction of the front wall of the container.

4. In combination with a refuse container as defined in claim 3 in which the bottom plate of said pocket is disposed horizontally with respect to the floor of said container in spaced relation to said top plate, and the side plate is disposed vertically between said top and bottom plates near the outer edges thereof.

5. In combination with a refuse container as defined in claim 1 in which the bottom plate of said pocket is disposed horizontally with respect to the floor of said container in spaced relation to said top plate, and the side plate is disposed vertically between said top and bottom plates near the outer edges thereof.

6. In combination with a refuse container as defined in claim 1 in which said top plate is even with said bottom and side plates at the back of said pocket, and an extension of said top plate projects past said bottom and side plates at the front of said pocket.

* * * * *